US011213141B2

(12) United States Patent
Matsumoto

(10) Patent No.: US 11,213,141 B2
(45) Date of Patent: Jan. 4, 2022

(54) BEDDING FOR BABIES AND INFANTS

(71) Applicant: Grandoir International Ltd., Nagakute (JP)

(72) Inventor: Junya Matsumoto, Nagakute (JP)

(73) Assignee: Grandoir International Ltd., Nagakute (JP)

( * ) Notice: Subject to any disclaimer, the term of this patent is extended or adjusted under 35 U.S.C. 154(b) by 165 days.

(21) Appl. No.: 16/377,587

(22) Filed: Apr. 8, 2019

(65) Prior Publication Data

US 2019/0231089 A1 Aug. 1, 2019

Related U.S. Application Data

(63) Continuation of application No. PCT/JP2016/083035, filed on Nov. 8, 2016.

(51) Int. Cl.
*A47D 7/00* (2006.01)
*A47D 15/00* (2006.01)
(Continued)

(52) U.S. Cl.
CPC ..... *A47D 7/002* (2013.01); *A47D 9/00* (2013.01); *A47D 9/005* (2013.01); *A47D 15/001* (2013.01);
(Continued)

(58) Field of Classification Search
CPC ..... A47D 7/002; A47D 9/00; A47D 9/005; A47D 15/005; A47D 15/008; A47D 5/006;
(Continued)

(56) References Cited

U.S. PATENT DOCUMENTS 2,626,407 A * 1/1953 Kurry ..... A47D 9/005 5/99.1
4,907,306 A * 3/1990 Nakaji ..... A47G 9/10 5/632
(Continued)

FOREIGN PATENT DOCUMENTS

CA 2196341 A 7/1998
JP S48-029650 Y1 9/1973
(Continued)

OTHER PUBLICATIONS

International Search Report and Written Opinion (Application No. PCT/JP2016/083035) dated Feb. 7, 2017.
(Continued)

*Primary Examiner* — David R Hare
*Assistant Examiner* — Madison Emanski
(74) *Attorney, Agent, or Firm* — Burr & Brown, PLLC

(57) ABSTRACT

A bedding for babies and infants includes two mattresses, wall-surface cushion materials, and handles. The two mattresses have mutually opposite sides that are coupled and have square shapes in planar views of the two mattresses. The wall-surface cushion materials are removably mounted on top surfaces of other three sides excluding the coupled sides of both the mattresses via coupling members. The handles removably mounted on both the mattresses or the wall-surface cushion materials. The wall-surface cushion materials are separably and mutually coupled between the adjacent wall-surface cushion materials via coupling members. The bedding for babies and infants is configured to be carried around with the handles in a state where both the mattresses are folded such that top surfaces of corresponding wall-surface cushion materials are abutted to be closed with a coupling member.

4 Claims, 10 Drawing Sheets

(51) Int. Cl.
*A47D 9/00* (2006.01)
*A47D 5/00* (2006.01)

(52) U.S. Cl.
CPC ..... *A47D 15/005* (2013.01); *A47D 15/008* (2013.01); *A47D 5/006* (2013.01)

(58) Field of Classification Search
CPC .. A47D 15/001; A47D 15/003; A47D 13/066; A47C 27/00; A47C 27/001
See application file for complete search history.

(56) References Cited

U.S. PATENT DOCUMENTS

| | | | | |
|---|---|---|---|---|
| 6,026,525 | A * | 2/2000 | Davis | A47D 7/002 5/655 |
| 9,032,572 | B1 * | 5/2015 | Leach | A47D 15/003 5/655 |
| 2002/0153753 | A1 | 10/2002 | Kassai | |
| 2007/0220679 | A1 | 9/2007 | Dockendorf et al. | |

FOREIGN PATENT DOCUMENTS

| | | | |
|---|---|---|---|
| JP | S64-016854 | U | 1/1989 |
| JP | H08-089365 | A1 | 4/1996 |
| JP | 3162739 | U | 9/2010 |
| JP | 3178197 | U | 9/2012 |
| JP | 3180196 | U | 12/2012 |
| JP | 3185097 | U | 8/2013 |
| WO | 02/017754 | A1 | 3/2002 |

OTHER PUBLICATIONS

Extended European Search Report (Application No. 16920968.1) dated May 6, 2020.

* cited by examiner

BEDDING FOR BABIES AND INFANTS

This application is a Continuation of International Application No. PCT/JP2016/083035, filed on Nov. 8, 2016, which claims the benefit of Japanese Patent Application Number 2017-515258 filed on Nov. 8, 2016, the disclosures of which are incorporated by reference herein in their entireties.

BACKGROUND OF THE INVENTION

Field of the Invention

The disclosure relates to a bedding for babies and infants. As the bedding for babies and infants, a ready-to-assemble crib and a baby comforter that is put in it are generally used. However, the generally used crib and baby comforter are originally unsuitable to carry around because of their structures. Recently, in association with diversification in lifestyle, the bedding for babies and infants convenient to carry around has been desired. The disclosure relates to an easy-to-use bedding for babies and infants that is convenient to carry around and easily rearranged corresponding to a specific purpose of use.

Background Art

Conventionally, as a bedding for babies and infants convenient to carry around, the following one has been proposed. The bedding is a box-shaped body, which is formed of a mattress that is rectangular in a planar view and wall-surface units raised from four peripheral edges of the mattress. A protect unit for preventing rolling is disposed on this box-shaped body. The mattress and the wall-surface units are folded along folding portions so that the bedding is formed into a tote bag or an over-the-shoulder compact bag (see Japanese Registered Utility Model No. 3162739). However, such conventional bedding for babies and infants has the following problems. A degree of freedom in rearrangement corresponding to the specific purpose of use is low since the wall-surface units are coupled to the mattress. An elastic body used for the mattress and the wall-surface units is limited to correspondingly thin and soft one, for example, one such as EVA foam since the bedding is formed into the compact bag by folding the mattress and the wall-surface units to carry around, thus actually being uncomfortable. Moreover, dust easily enters the compact bag since it has many gaps.

Conventionally, as the bedding for babies and infants convenient to carry around, the following one has been proposed. The bedding includes a reinforcing cloth that is rectangular in a planar view, a frame body that has totally a square O shape raised from four peripheral edges of the reinforcing cloth and is configured to be folded in two at the center, and handles disposed on mutually opposite two sides of the reinforcing cloth. The bedding is carried around with the handles in a state where the frame body having totally the square O shape is folded in two at the center to cause both top surfaces to abut on mutually (for example, see Japanese Registered Utility Model No. 3180196). However, such conventional bedding for babies and infants has the following problems. The degree of freedom in rearrangement corresponding to the specific purpose of use is low since the frame body is coupled to the reinforcing cloth. Actually, to use it as the bedding for babies and infants, a mattress needs to be differently placed on the reinforcing cloth.

SUMMARY OF THE INVENTION

An object of the disclosure is to provide a bedding for babies and infants that has a high degree of freedom in rearrangement corresponding to a specific purpose of use, and is comfortable without differently preparing a mattress, and keeps a decent sealing performance when being carried around, thus preventing dust from easily entering the bedding.

The disclosure to solve the above-described problem provides a bedding for babies and infants including two mattresses, wall-surface cushion materials, and handles. The two mattresses have mutually opposite sides that are coupled and have square shapes in planar views of the two mattresses. The wall-surface cushion materials are removably mounted on top surfaces of other three sides excluding the coupled sides of both the mattresses via coupling members. The handles removably mounted on both the mattresses or the wall-surface cushion materials. The wall-surface cushion materials are separably and mutually coupled between the adjacent wall-surface cushion materials via coupling members. The bedding for babies and infants is configured to be carried around with the handles in a state where both the mattresses are folded such that top surfaces of corresponding wall-surface cushion materials are abutted to be closed with a coupling member.

The bedding for babies and infants according to the disclosure includes the two mattresses, the plurality of wall-surface cushion materials, the handles, and the plurality of coupling members. The two mattresses each are usually formed of one obtained such that an elastic body such as a foam, a rubber, and a compressed cotton is put in a bag-shaped article manufactured from a reinforcing cloth, or formed of an air mattress, and have a square shape or a rectangular square shape in a planar view. Such two mattresses usually have approximately identical shapes, and their mutually opposite sides are usually coupled on lower surfaces. Coupling means in this case may be any of a zipper, a hook-and-loop fastener, a snap-button, stitching using a reinforce cloth for coupling, and the like. For example, the reinforcing cloth for coupling is stitched onto the lower surfaces of the sides in a state where the reinforcing cloth for coupling is passed across between the corresponding sides of both the mattresses.

In the bedding for babies and infants according to the disclosure, the plurality of wall-surface cushion materials each are usually formed of one obtained such that an elastic body such as a foam, a rubber, and a compressed cotton is put in a bag-shaped article manufactured from reinforcing cloth, or an air cushion, and have a cuboid. Such wall-surface cushion materials are removably mounted on the top surfaces of the other three sides excluding the sides, on which both the mattresses are coupled, via the coupling members. Further, the wall-surface cushion materials are separably and mutually coupled between the adjacent wall-surface cushion materials via the coupling members. Coupling means in this case may be any of a zipper, a hook-and-loop fastener, a snap-button, and the like, and two or more of them can be used together. The plurality of wall-surface cushion materials are each independently and removably mounted as walls on peripheral edges of the top surfaces of the two mattresses, and also mutually and separably coupled. Thus, the plurality of wall-surface cushion materials are allowed to be individually changed and cleaned. Additionally, for example, when the wall-surface cushion materials positioned on a side of both the mattresses among the plurality of wall-surface cushion materials are removed from the mattresses, the bedding for babies and infants according to the invention can be used as one for co-sleeping.

Among the plurality of wall-surface cushion materials, the wall-surface cushion materials opposite to mutually across the sides, on which both the mattresses are coupled, are preferably coupled on their top surfaces. Thus, positional deviation does not occur to facilitate folding when both the mattresses are folded such that the top surfaces of the corresponding wall-surface cushion materials are abutted on with the sides, on which both the mattresses are coupled, as an axis. Coupling means in this case may be any of a zipper, a hook-and-loop fastener, a snap-button, stitching, and the like, but mutually stitching the top surfaces of the wall-surface cushion materials mutually opposite to across the sides, on which both the mattresses are coupled, is preferred.

Auxiliary cushion materials can be removably mounted inside the wall-surface cushion materials mounted on the top surfaces of the other three sides of one mattress via coupling members, and the auxiliary cushion materials project above the wall-surface cushion materials. Such auxiliary cushion materials can prevent danger that the baby or the infant exceeds the wall-surface cushion materials, for example, when rolling over. The auxiliary cushion material is configured similarly to the wall-surface cushion material in total, but configured thinner than the wall-surface cushion material because of its nature. As the coupling member in this case, a zipper, a hook-and-loop fastener, a snap-button, and the like can be used, and two or more of them can be used together.

The bedding for babies and infants according to the disclosure includes the handles. The handles are convenient to carry around in a state where both the mattresses are folded such that the top surfaces of the corresponding wall-surface cushion materials are abutted to be closed with the coupling member. Such handles can be mounted on lower surfaces or side surfaces (side surfaces or top surfaces after folding) of sides opposite to the sides, on which both the mattresses are coupled, or can be mounted on side surfaces (top surfaces after folding) of similarly opposite sides of the wall-surface cushion materials. The coupling member used when both the mattresses are folded to be the closed state may be any of a zipper, a hook-and-loop fastener, a snap-button, and the like, and two or more of them can be used together.

The bedding for babies and infants according to the disclosure includes the plurality of coupling members. The coupling member has been already described, but may be any of a zipper, a hook-and-loop fastener, a snap-button, and the like, and two or more of them can be used together.

The bedding for babies and infants according to the disclosure is carried around with the handles in the state where both the mattresses are folded such that the top surfaces of the corresponding wall-surface cushion materials are abutted to be closed with the coupling members with the sides, on which both the mattresses are coupled, as the axis. When both the mattresses are closed, a decent space is formed inside. Using such space, a pillow, a comforter, an inclined cushion material, a replacement pad, and the like can be appropriately housed.

As described above, the bedding for babies and infants according to the disclosure has effects that the degree of freedom in rearrangement corresponding to the specific purpose of use is high, the comfort is ensured without differently preparing the mattress, and the decent sealing performance is kept when the bedding is carried around, thus preventing the dust from easily entering the bedding.

DETAILED DESCRIPTION OF THE INVENTION

Figure 1:
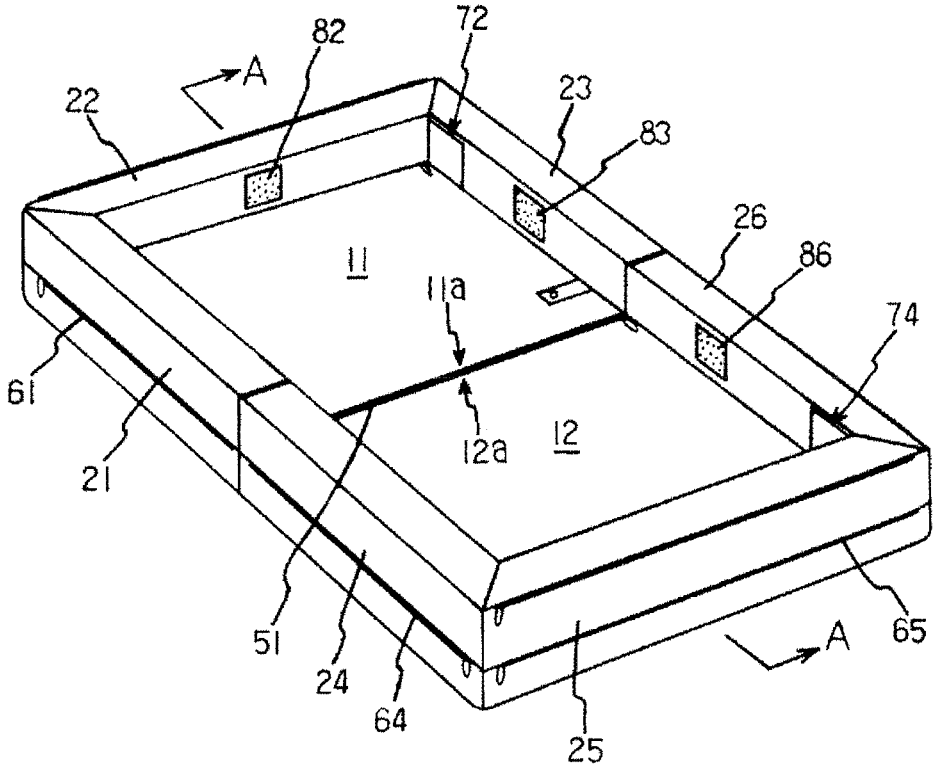
FIG. 1 is a perspective view exemplifying a bedding for babies and infants according to the disclosure in an open state.
Figure 2:
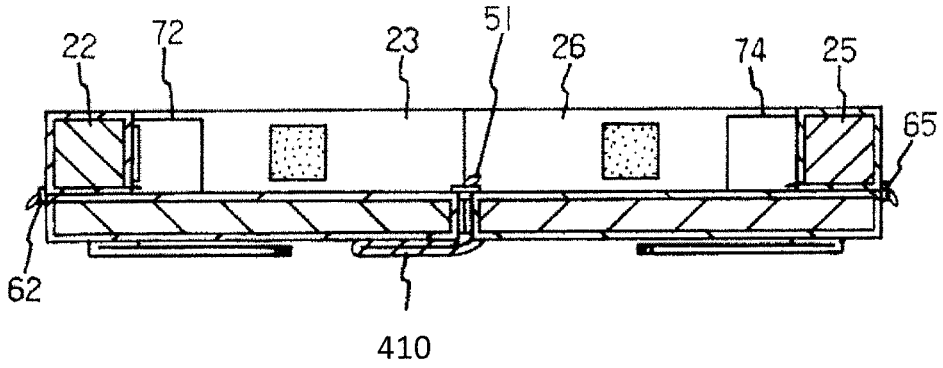
FIG. 2 is a vertical cross-sectional view taken along a line A-A in FIG. 1.

A bedding for babies and infants illustrated in FIG. 1 to FIG. 4 includes two mattresses 11, 12, six wall-surface cushion materials 21 to 26, a pair of handles 31, 32, a plurality of coupling members, and the like. The two mattresses 11, 12 are formed of ones obtained such that a block of a compressed cotton made of polyester as an elastic body is put in a bag-shaped article manufactured from a reinforcing cloth. The two mattresses 11, 12 have approximately square shapes having an identical size when being individually viewed planarly, and have approximately rectangular shape when being viewed planarly in a state where the two are coupled. The two mattresses 11, 12 are coupled with a reinforcing cloth for coupling 410 stitched across and between them on lower surfaces of mutually opposite sides 11*a*, 12*a*. The two mattresses 11, 12 are coupled separably with a zipper 51 as a coupling member on top surfaces of the mutually opposite sides 11*a*, 12*a*.

Figure 3:
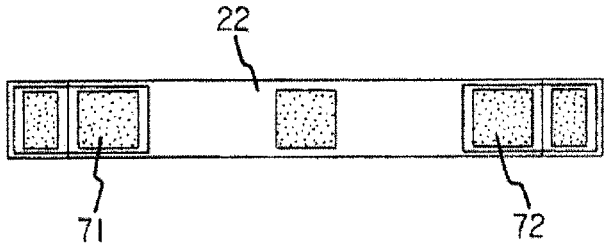
FIG. 3 is a front view illustrating a wall-surface cushion material positioned on one side surface in FIG. 1.
Figure 4:
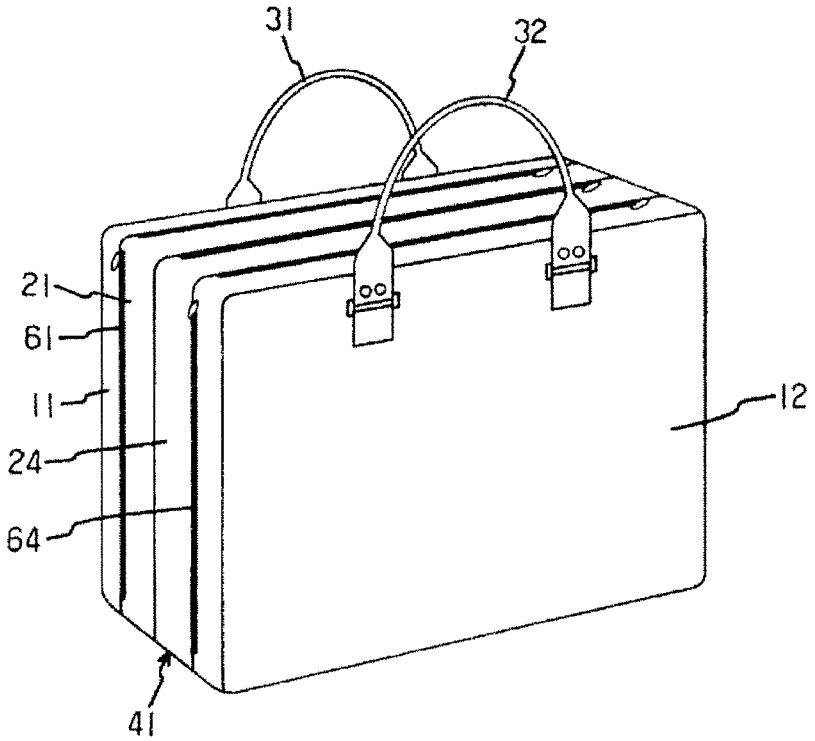
FIG. 4 is a perspective view illustrating the bedding for babies and infants in FIG. 1 in a closed state.

The total six wall-surface cushion materials 21 to 26 are each formed of one obtained such that a block of a compressed cotton made of polyester as an elastic body is put in a bag-shaped article manufactured from a reinforcing cloth, thus having a cuboid. Such wall-surface cushion materials 21 to 26 are removably mounted on top surfaces of other three sides excluding the sides 11*a*, 12*a*, on which both the mattresses 11, 12 are coupled, with zippers 61 to 66 (however, a part of the zippers is not illustrated) as coupling members. The wall-surface cushion materials 21 to 23 are mutually, and the wall-surface cushion materials 24 to 26 are also mutually coupled separably with hook-and-loop fasteners 71 to 74 (however, a part of the hook-and-loop fasteners is not illustrated) as coupling members. For convenience of illustration, the hook-and-loop fasteners 71, 72 in FIG. 3 are illustrated in a separate state (open state). Further, the top surfaces of the wall-surface cushion material 21 and the wall-surface cushion material 24 mutually opposite across the sides 11*a*, 12*a*, on which both the mattresses 11, 12 are coupled, are stitched. Similarly, the top surfaces of the wall-surface cushion material 23 and the wall-surface cushion material 26 are stitched. Instead of such stitching, zippers, hook-and-loop fasteners, snap-buttons, and the like can be used.

Figure 5:
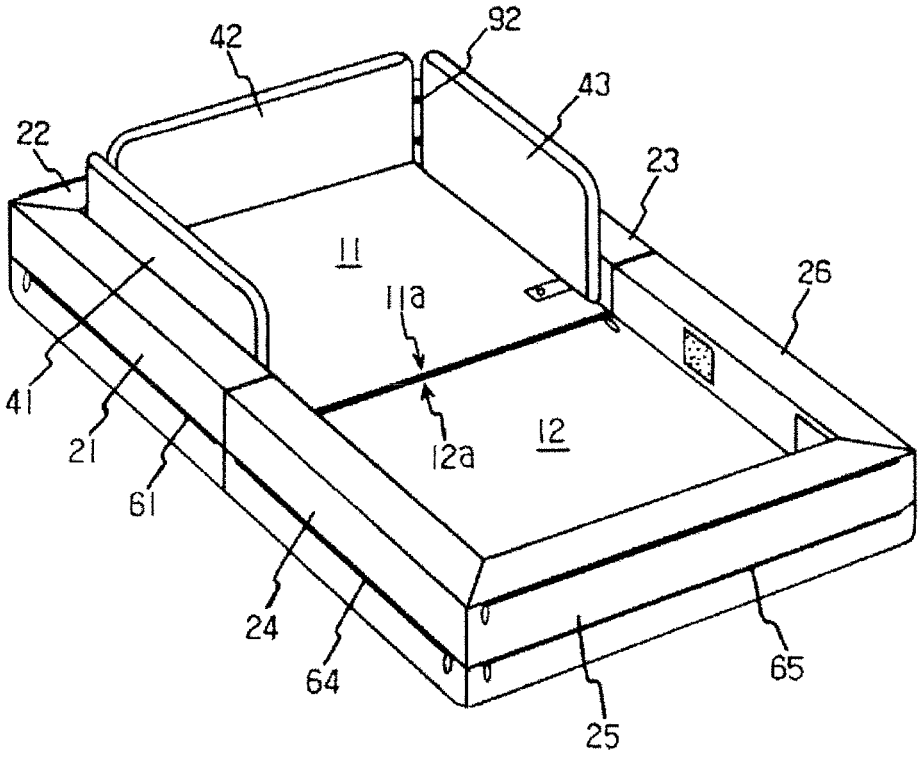
FIG. 5 is a perspective view illustrating the bedding for babies and infants in FIG. 1 in another use state.
Figure 6:
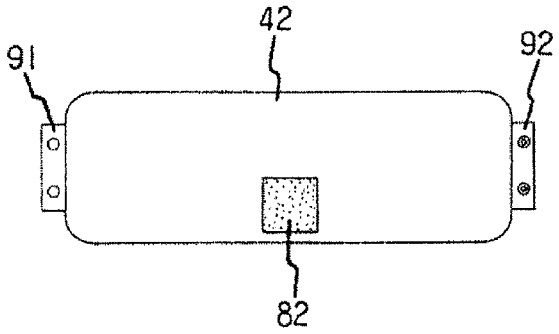
FIG. 6 is a back view illustrating an auxiliary cushion material positioned on one side surface in FIG. 5.

FIG. 5 and FIG. 7 to FIG. 10 each illustrate the bedding for babies and infants in FIG. 1 in another use state. However, for convenience of explanation, reference numerals identical to those in FIG. 1 designate constituting members identical to those in FIG. 1. In FIG. 5 and FIG. 6, auxiliary cushion materials 41 to 43 formed thinner than the wall-surface cushion materials 21 to 23 are mounted inside the wall-surface cushion materials 21 to 23 mounted on the three sides of the one mattress 11, in a state that the auxiliary cushion materials 41 to 43 project above the wall-surface cushion materials 21 to 23. The auxiliary cushion materials 41 to 43, similarly to the wall-surface cushion materials 21 to 23, are formed of ones obtained such that a block of a compressed cotton made of polyester as an elastic body is put in a bag-shaped article manufactured from a reinforcing cloth, and removably mounted inside the wall-surface cushion materials 21 to 23 with hook-and-loop fasteners 81 to 83 (however, a part of the hook-and-loop fasteners is not illustrated) as coupling members. The auxiliary cushion materials 41 to 43 are also mutually coupled separably with snap-buttons 91, 92 as coupling members.

Figure 7:
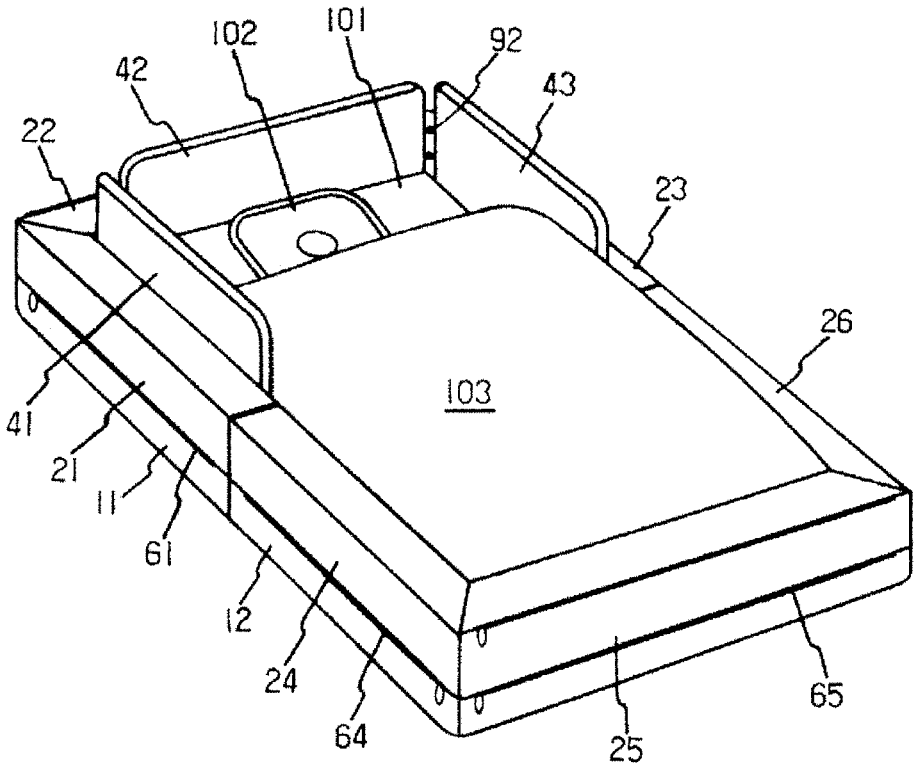
FIG. 7 is a perspective view illustrating the bedding for babies and infants in FIG. 1 in a still another use state.

In FIG. 7, a replacement pad 101 is placed on the mattresses 11, 12, a pillow 102 is placed on a side of the auxiliary cushion material 42 of the replacement pad 101, and a comforter 103 is covered at a part excluding the vicinity of the pillow 102 of the replacement pad 101. Other configurations and the like whose description is omitted here are identical to those in FIG. 1 and FIG. 5.

Figure 8:
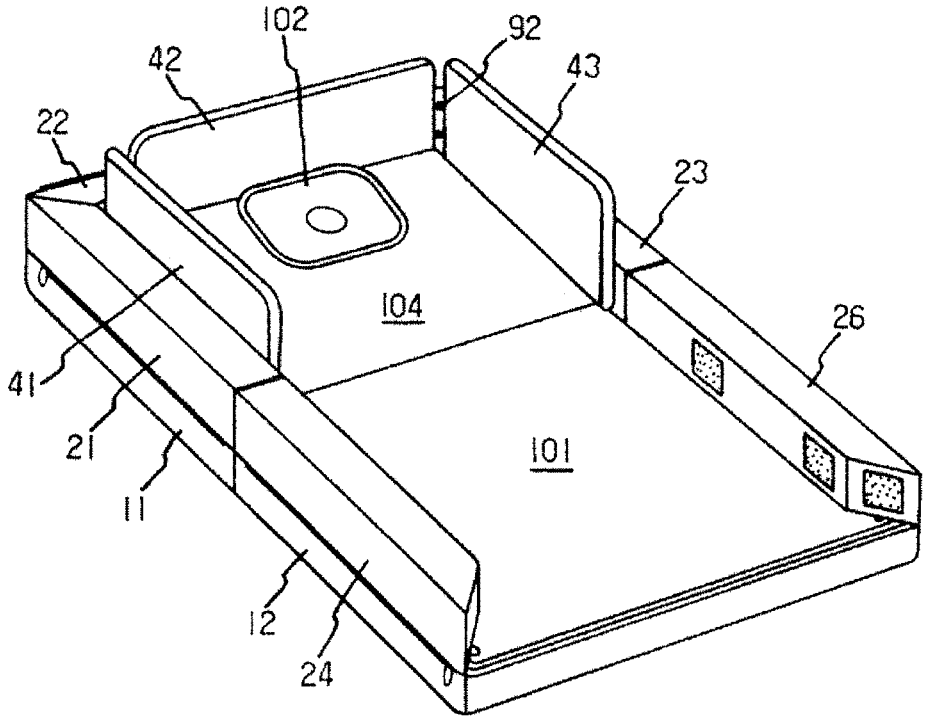
FIG. 8 is a perspective view illustrating the bedding for babies and infants in FIG. 1 in a still another use state.

In FIG. 8, the wall-surface cushion material 25 among the wall-surface cushion materials 21 to 26 is removed. The replacement pad 101 is placed on the mattresses 11, 12, an inclined cushion material 104 is placed on a side of the mattress 11 of the replacement pad 101, and the pillow 102 is placed on the auxiliary cushion material 42 side of the inclined cushion material 104. Other configurations and the like whose description is omitted here are identical to those in FIG. 1 and FIG. 5.

Figure 9:
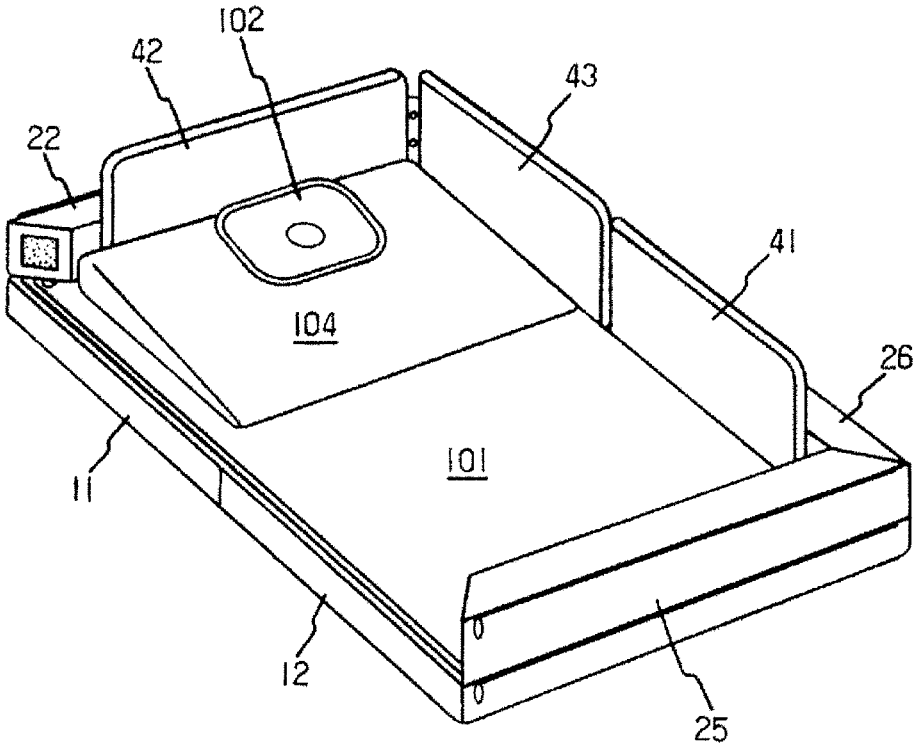
FIG. 9 is a perspective view illustrating the bedding for babies and infants in FIG. 1 in a still another use state.

In FIG. 9, the wall-surface cushion materials 21, 24 among the wall-surface cushion materials 21 to 26 are removed. The auxiliary cushion material 41 among the auxiliary cushion materials 41 to 43 is removably mounted inside the wall-surface cushion material 26 via the hook-and-loop fastener as the coupling member. The replacement pad 101 is placed on the mattresses 11, 12, the inclined cushion material 104 is placed on the mattress 11 side of the replacement pad 101, and the pillow 102 is placed on the auxiliary cushion material 42 side of the inclined cushion material 104. Other configurations and the like whose description is omitted here are identical to those in FIG. 1 and FIG. 5.

Figure 10:
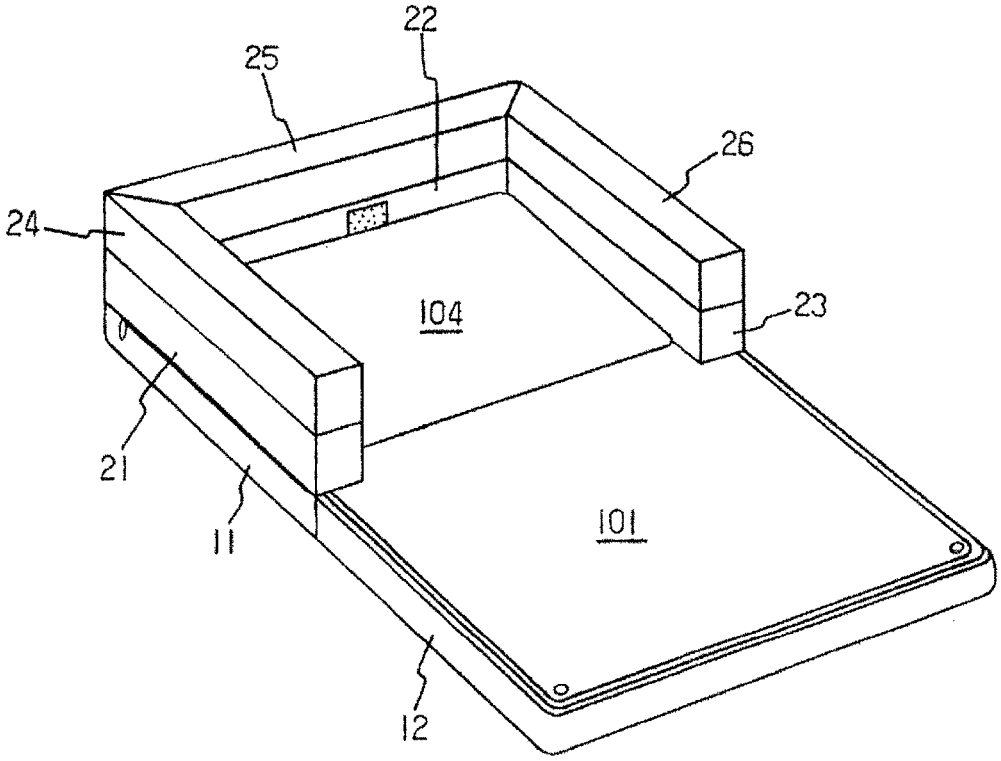
FIG. 10 is a perspective view illustrating the bedding for babies and infants in FIG. 1 in a still another use state.

In FIG. 10, the wall-surface cushion materials 24 to 26 among the wall-surface cushion materials 21 to 26 are placed on the wall-surface cushion materials 21 to 23, and the wall-surface cushion material 22 and the wall-surface cushion material 25 are separably coupled with the zipper. The replacement pad 101 is placed on the mattresses 11, 12, and the inclined cushion material 104 is placed on the mattress 11 side of the replacement pad 101. Other configurations and the like whose description is omitted here are identical to those in FIG. 1 and FIG. 5.

The bedding for babies and infants in FIG. 1 originally has the mattresses 11, 12, thus it is not necessary to the need to differently prepare the mattress. Additionally, the mattress 11 and the mattress 12 are coupled on their top surfaces, thus preventing a part of the body of a baby or an infant from being depressed or caught between them. Besides, the beddings for babies and infants in FIG. 5 and FIG. 7 include the auxiliary cushion materials 41 to 43, thus preventing the baby or the infant from exceeding the wall-surface cushion materials 21 to 23, for example, when rolling over. The bedding for babies and infants in FIG. 8 is convenient in a diaper change. The beddings for babies and infants in FIG. 9 and FIG. 10 are convenient in co-sleeping. Any of the beddings for babies and infants can be carried around as in FIG. 4, thus having a good sealing performance when being carried around and stored.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A bedding for babies and infants comprising:

two mattresses having mutually opposite sides that are coupled and having square shapes in planar views of the two mattresses;

a reinforcing cloth stitched across the two mattresses in a layered manner along outermost lower surfaces of the respective mutually opposite sides of the two mattresses;

wall-surface cushion materials removably mounted on top surfaces of other three sides, excluding the coupled sides, of both of the mattresses via coupling members; and handles removably mounted on both of the mattresses or on the wall-surface cushion materials, wherein the wall-surface cushion materials are separably and mutually coupled between the adjacent wall-surface cushion materials via coupling members, and wherein the bedding for babies and infants is configured to be carried around with the handles in a state where both of the mattresses are folded such that the respective top surfaces of corresponding wall-surface cushion materials are abutted to be closed with a coupling member.

2. The bedding for babies and infants according to claim 1, wherein both of the mattresses are coupled separably on the top surfaces of the coupled sides via a coupling member.

3. The bedding for babies and infants according to claim 1, further comprising auxiliary cushion materials removably mounted inside the wall-surface cushion materials mounted on the top surfaces of the other three sides of one mattress via coupling members, wherein the auxiliary cushion materials project above the wall-surface cushion materials.

4. The bedding for babies and infants according to claim 1, wherein the coupling member is at least one of a zipper, a hook-and-loop fastener, and a snap-button.

* * * * *